United States Patent [19]

Imai et al.

[11] Patent Number: 4,769,843

[45] Date of Patent: Sep. 6, 1988

[54] STEREO SIGNAL REPRODUCING SYSTEM

[75] Inventors: Hiroshi Imai; Junichi Kasai, both of Kanagawa, Japan

[73] Assignee: Nissan Motor Company, Limited, Yokohama, Japan

[21] Appl. No.: 838,777

[22] Filed: Mar. 12, 1986

[30] Foreign Application Priority Data

Mar. 14, 1985 [JP] Japan ..... 60-50944

[51] Int. Cl.[4] ..... H04R 5/02

[52] U.S. Cl. ..... 381/24; 381/86

[58] Field of Search ..... 381/24, 27, 86, 17, 381/18, 1

[56] References Cited

U.S. PATENT DOCUMENTS

| | | | |
|---|---|---|---|
| 4,039,755 | 8/1977 | Berkovitz | 381/27 |
| 4,509,184 | 4/1985 | Yanagawa | 381/27 |
| 4,521,906 | 6/1985 | Kahn | 381/24 |
| 4,594,729 | 6/1986 | Weingartner | 381/86 |

FOREIGN PATENT DOCUMENTS

| | | | |
|---|---|---|---|
| 223889A | 6/1985 | German Democratic Rep. | 381/27 |
| 59-182700 | 10/1984 | Japan . | |

*Primary Examiner*—Forester W. Isen

*Attorney, Agent, or Firm*—Foley & Lardner Schwartz, Jeffery, Schwaab, Mack, Blumenthal & Evans

[57] ABSTRACT

A system for reproducing stereophonic signal to create a stereophonic sound image in front of each of listeners sitting side by side in a compartment. The system includes a first loudspeaker positioned relative to the right of the first listener sitting on the right, a second side loudspeaker positioned relative to the left of the second listener sitting on the left, and a center loudspeaker unit positioned between the first and second side loudspeakers. A signal generator generates R and L stereophonic signals. The R signal is applied to drive the first side loudspeaker and the L signal is applied to drive the second side loudspeaker. The R and L signals are applied to drive the center loudspeaker unit. The signal generator includes a device for providing a predetermined time delay to the R and L signals applied to drive the center loudspeaker unit with respect to the signals applied to drive the first and second side loudspeakers.

9 Claims, 3 Drawing Sheets

STEREO SIGNAL REPRODUCING SYSTEM

BACKGROUND OF THE INVENTION

This invention relates to a system for acoustical reproductions of stereophonic signals and, more particularly, to a stereo signal reproducing system suitable in use for listeners sitting side by side in a compartment such for example as a vehicle compartment.

It is well known in the art that right- and left-hand loudspeakers be positioned, with a proper space, at the same distance with respect to a listener in order to achieve high-quality acoustical reproductions of stereophonic signals. In some cases, however, it is difficult to satisfy this requirement. This is true particularly in reproducing stereophonic signals for listeners sitting side by side in a relatively small compartment such for example as a vehicle compartment.

Therefore, it is the problem in the art to provide an apparatus for acoustical reproductions of stereophonic signals which can produce a stereophonic sound image at a proper location in front of each of listeners sitting side by side in a compartment, thereby providing significantly more listening pleasure.

SUMMARY OF THE INVENTION

There is provided, in accordance with the present invention, a system for reproducing stereophinic signals to create stereophinic sound image in front of each of first and second listeners sitting side by side in a compartment. The system comprises a first side loudspeaker positioned relative to the right of the first listener sitting on the right, a second side loudspeaker positioned relative to the left of the second listener sitting on the left, and a center loudspeaker unit positioned between the first and second side loudspeakers. A signal generator circuit generates R- and L-channel stereophonic signals, the R-channel signal being applied to drive the first side loudspeaker, the L-channel signal being applied to drive the second side loudspeaker. The R- and L-channel signals are delayed a predetermined time and applied to drive the center loudspeaker unit.

The center loudspeaker unit may include a first center loudspeaker positioned relative to the left of the first listener sitting on the right and a second center loudspeaker positioned relative to the right of the second listener sitting on the left. In this case, the L-channel signal is applied to drive the first center loudspeaker and the R-channel signal is applied to the second center loudspeaker.

In another aspect, the center loudspeaker unit may include a single center loudspeaker. In this case, the signal generator circuit includes a device for electrically adding the R- and L-channel signals to provide an L+R signal. The L+R signal is delayed and applied to drive the center loudspeaker.

Accordingly, either of the listeners can listen to an R-channel sound with his right ear and an L-channel sound with his left ear.

BRIEF DESCRIPTION OF THE DRAWINGS

The present invention will be described in greater detail by reference to the following description taken in connection with the accompanying drawings, in which.

DETAILED DESCRIPTION OF THE INVENTION

Figure 1:
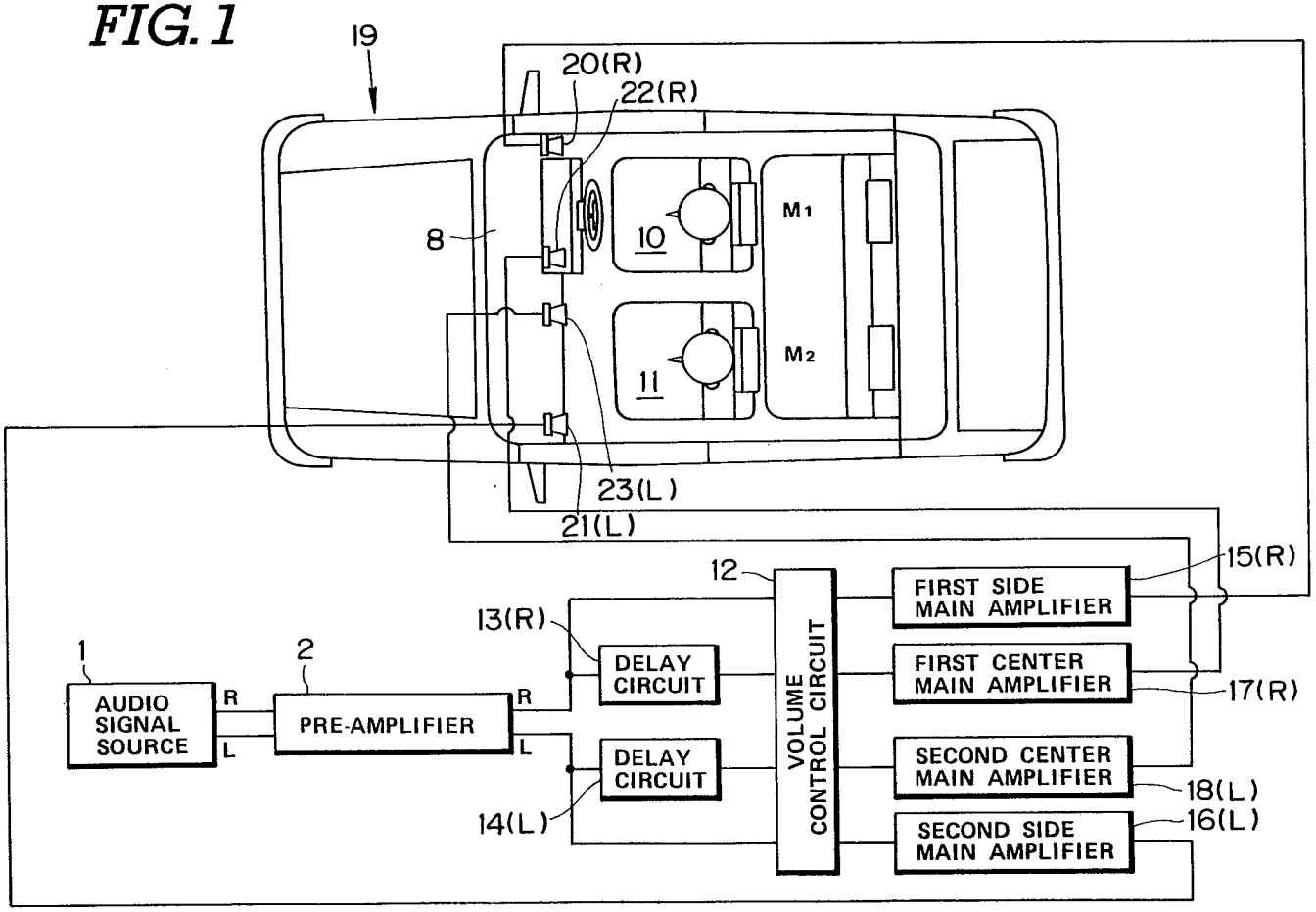
FIG. 1 is a schematic diagram showing one embodiment of a stereophonic signal reproducing system made in accordance with the present invention.
Figure 2:
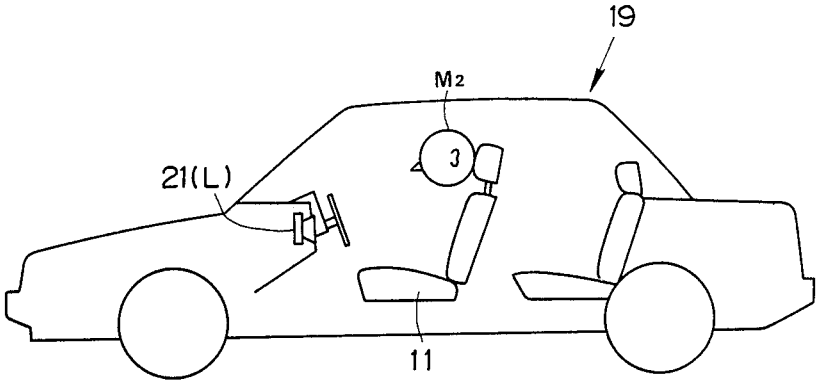
FIG. 2 is a schematic side view used in explaining the position of the loudspeaker with respect to a passenger.

With reference to the drawings, wherein like numerals refer to like parts in the several views, and in particular to FIGS. 1 and 2, the reference numeral 8 designates an instrument panel on which right- and left-hand side loudspeakers 20(R) and 21(L) and right- and left-hand center loudspeakers 22(R) and 23(L) are mounted at suitable positions. The right-hand side loudspeaker 20(R) is located relative to the right of the right-hand front seat 10 on which a passenger M1 sits. The right-hand center loudspeaker 22(R) is located on the left of the right-hand front seat 10 in such a fashion that the right-hand side and center loudspeakers 20(R) and 22(R) are positioned substantially at the same distance with respect to the passenger M1. The left-hand side loudspeaker 21(L) is located relative to the left of the left-hand front seal 11 on which a passenger M2 sits. The left-hand center loudspeaker 23(L) is located relative to the right of the left-hand front seat 11 in such a fashion that the left-hand side and center loudspeaker 21(L) and 23(L) are positioned substantially at the same distance with respect to the passenger M2. The left-hand center loudspeaker 23(L) is placed at a smaller distance with respect to the passenger M2 than the right-hand center loudspeaker 22(R). The loudspeakers 20(R), 21(L), 22(R) and 23(L) are connected to receive stereophonic signals from a stereophonic signal generator circuit for acoustical reproductions of stereophonic sound corresponding to the received stereophonic signals.

The signal generator circuit includes a pre-amplifier 2 which receives stereophonic signals from a program source 1 for converting the received signals into right (or R) and left (or L) electrical signals. The program source 1 may be a cassette tape player, a compact disc player, a stereo tuner, or the like. The R signal is fed directly to a volume control circuit 12 and also through an R-channel delay circuit 13(R) to the volume control circuit 12. The R-channel delay circuit 13(R) is effective to delay the received R signal a predetermined time, for example, 0.8 milliseconds. Similarly, the L signal is fed directly to the volume control circuit 12 and also through an L-channel delay circuit 14(L) to the volume control circuit 12. The L-channel delay circuit 14(L) is effective to provide a time delay, for example, 0.8 milliseconds to the received L signal.

The volume control circuit 12 is arranged to allow independent level control for the received four signals to vary the volumes of sound produced from the respective loudspeakers. The volume control cirkcuit 12 may be set in such a manner that the volumes of sound produced from the center loudspeaker 22(R) and 23(L) are somewhat greater than the volumes of sound produced from the side loudspeakers 20(R) and 21(L). The level-controlled signals are fed from the volume control circuit 12 to main amplifiers 15(R), 16(L), 17(R) and 18(L). The first side main amplifier 15(R) drives the right-hand side loudspeaker 20(R). The second side main amplifier 16(L) drives the left-hand side loudspeaker 21(L). The first center main amplifier 17(R) drives the right-hand center loudspeaker 22(R). The second center main amplifier 18(L) drives the right-hand center loudspeaker 23(L).

With respect to the passenger M1 seating on the right-hand front seat 10, the sound balance is influenced by the sounds produced from the right-hand side loudspeaker 20(R) and the right- and left-hand center loudspeakers 22(R) and 23(L). The influence of the sound produced from the left-hand side loudspeaker 21(L) is negligible. The R signal, which is applied to drive the right-hand center loudspeaker 22(R) so as to produce an R sound, is delayed a predetermined time with respect to the R signal which is applied to drive the right-hand side loudspeaker 20(R) so as to produce an R sound. Consequently, the passenger M1 will will feel the R sound produced from the right-hand center loudspeaker 22(R) as an echo sound produced from the right-hand side loudspeaker 20(R). The L sound produced from the left-hand center loudspeaker 23(L) has a channel different from that of the R sound produced from the right-hand side loudspeaker 20(R) and thus it does not cause the passenger M1 to feel the L sound as an echo sound produced from the right-hand side loudspeaker 20(R). The L sound produced from the left-hand center loudspeaker 23(L) reaches the left ear of the passenger M1 and causes the passenger M1 to feel a stereophonic sound image along with the R sound produced from the right-hand side loudspeaker 20(R). In other words, the passenger M1 listens to the R sound with his right ear and the L sound with his left ear. Since the volume of the sound produced from the left-hand center loudspeaker 23(L) is greater than the volume of the sound produced from the right-hand side loudspeaker 20(R), as described previously, a good sound balance can be achieved to produce a stereophonic sound image in front of the passenger M1. The R sound produced from the right-hand center loudspeaker 22(R) causes the passenger M1 to feel it as an echo sound produced from the right-hand side loudspeaker 20(R) so as to produce a spreaded sound image.

With respect to the passenger M2 sitting on the left-hand front seat 11, the sound balance is influenced by the sounds produced from the left-hand side loudspeaker 21(L) and the right- and left-hand center loudspeaker 22(R) and 23(L). The influence of the sound produced from the right-hand side loudspeaker 20(R) is negligible. The L signal, which is applied to drive the left-hand center loudspeaker 23(L) so as to produce an L sound, is delayed a predetermined time with respect to the L signal which is applied to drive the left-hand side loudspeaker 21(L) so as to produce an L sound. Consequently, the passenger M2 will feedl the L sound produced from the left-hand center loudspeaker 23(L) as an echo sound produced from the left-hand side loudspeaker 21(L). The R sound produced from the right-hand center loudspeaker 22(R) has a channel different from that of the L sound produced from the left-hand side loudspeaker 21(L) and thus it does not cause the passenger M2 to feel the R sound as an echo sound produced from the left-hand side loudspeaker 21(L). The R sound produced from the right-hand side loudspeaker 22(R) reaches the right ear of the passenger M2 and causes the passenger M2 to feel a stereophonic sound image along with the L sound produced from the left-hand side loudspeaker 21(L). In other words, the passenger M2 listens the R sound with his right ear and the L sound with his left ear. Since the volume of the sound produced from the right-hand center loudspeaker 22(R) is greater than the volume of the sound produced from the left-hand side loudspeaker 21(L), as described previously, a good sound balance can be achieved to produce a stereophonic sound image in front of the passenger M2. The L sound produced from the left-hand center loudspeaker 23(L) as an echo sound produced from the left-hand side loudspeaker 21(L) so as to produce a spreaded sound image.

Although the right- and left-hand center loudspeakers 22(R) and 23(L) are shown as directed just to the back, it is to be noted that more clear sound images can be obtained by positioning them in such a fashion that the right-hand center loudspeaker 22(R) has a primary acoustical axis directed to the passenger M2 and the left-hand center loudspeaker 23(L) has a primary acoustical axis directed to the passenger M1.

Figure 4:
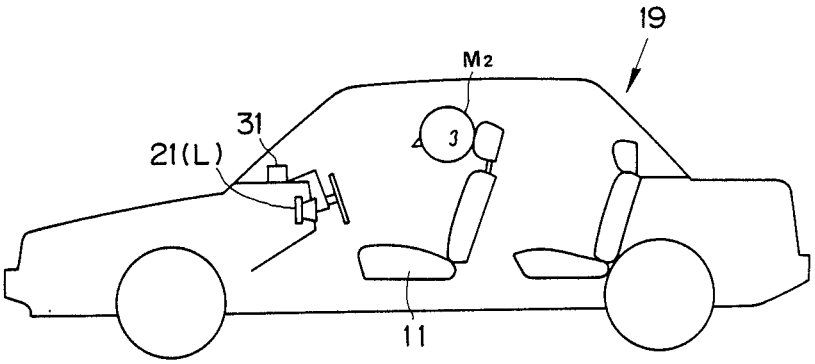
FIG. 4 is a schematic side view used in explaining the position of the loudspeaker with respect to a passenger.
Figure 3:
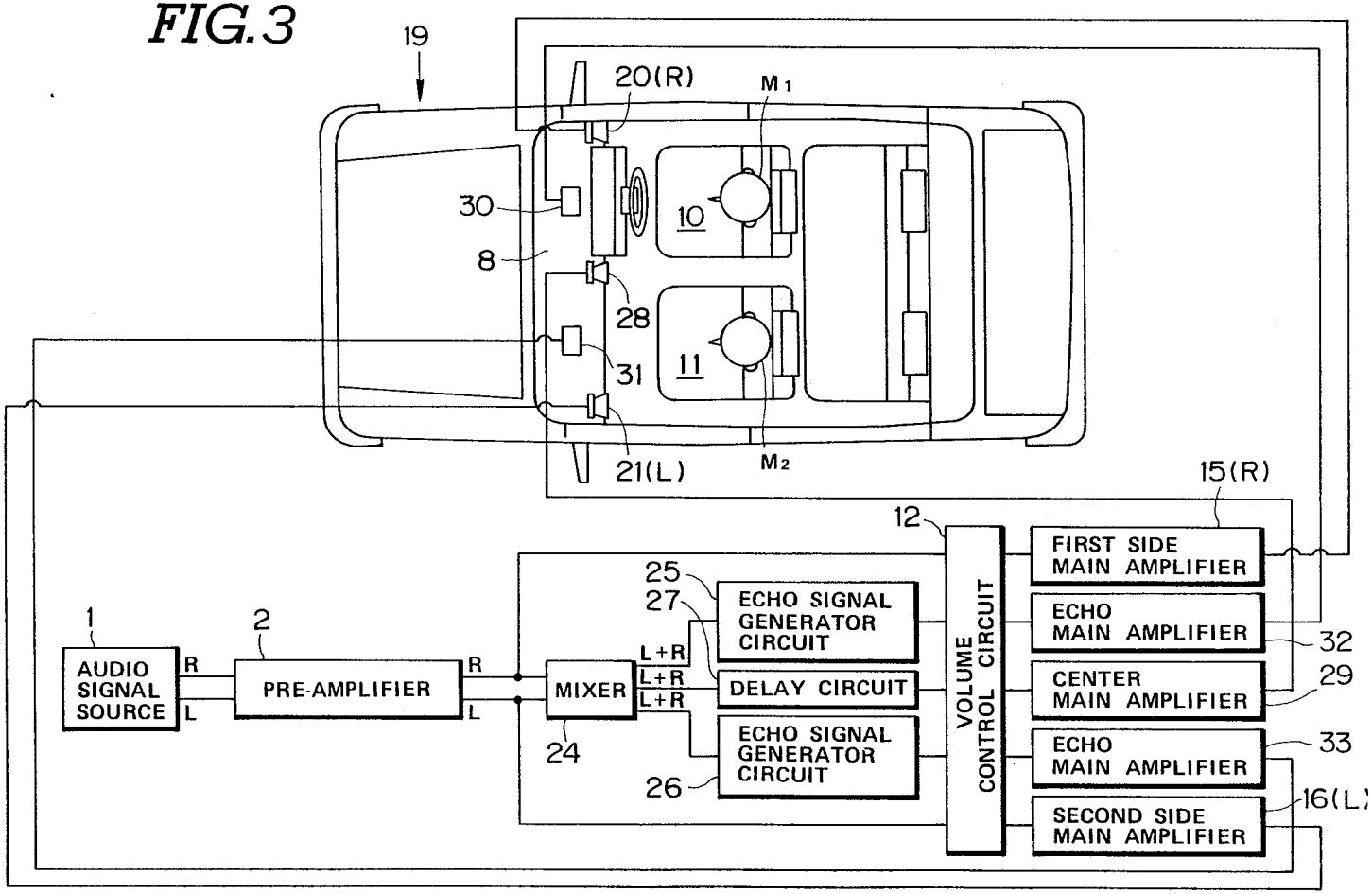
FIG. 3 is a schematic diagram showing a modified form of the stereophonic signal reproducing system.

Referring to FIGS. 3 and 4, there is illustrated another embodiment of the stereo signal reproducing system of the present invention. In this embodiment, the right- and left-hand center loudspeakers 22(R) and 23(L) are removed and replaced by a single center loudspeaker 28 which is mounted on the instrument panel 8 substantially at the intermediate between the right- and left-hand side loudspeakers 20(R) and 21(L). A first echo sound loudspeaker 30 is placed on the instrument panel 8 between the right-hand side loudspeaker 20(R) and the center loudspeaker 28 and preferably in front of the passenger M1 sitting on the right-hand front seat 10. A second echo sound loudspeaker 31 is provided on the instrument panel 8 between the left-hand side loudspeaker 21(L) and the center loudspeaker 28 and preferably in front of the passenger M2 sitting on the left-hand front seat 11.

Like the first embodiment, the pre-amplifier 2 receives stereophonic signals from a program source 1 and generates right (or R) and left (or L) electrical signals. The R signal is fed from the pre-amplifier 2 to the volume control circuit 12 and also to a mixer 24. The L signal is fed from the pre-amplifier 2 to the volume control circuit 12 and also to the mixer 24. The mixer 24 electrically adds the R and L signals fed thereto from the pre-amplifier 2 and provides an L+R signal. The L+R signal is applied through a first echo signal generator circuit 25 to the volume control circuit 12, through a time delay circuit 27 to the volume control circuit 12, and through a second echo signal generator circuit 26 to the volume control circuit 12. The echo signal generator circuits 26 and 27 are effective to generate echo signals corresponding to the received L+R signals, respectively. The time delay circuit 27 provides a predetermined time delay to the L+R signal fed therethrough.

The volume control circuit 12 is arranged to allow independent level control for the received five signals to vary the volumes of sound produced from the respective loudspeakers. The volume control circuit 12 may be set in such a manner that the volume of the center loudspeaker 28 is somewhat greater than the volumes of the sound produced from the right- and left-hand side loudspeakers 20(R) and 21(L). The level-controlled signals are fed from the volume control circuit 12 to main amplifiers 15(R), 16(L), 29, 32 and 33. The first side main amplifier 15(R) drives the right-hand side loudspeaker 20(R). The second side main amplifier 16(L) drives the left-hand side loudspeaker 21(L). The center main amplifier 29 drives the center loudspeaker 28. The first echo main amplifier 32 drives the first echo sound loudspeaker 30. The second echo main amplifier 33 drives the second echo sound loudspeaker 31.

With respect to the passenger M1 seating on the right-hand front seat 10, the sound balance is influenced by the sounds produced from the right-hand side loudspeaker 20(R) and the center loudspeaker 28. The L+R signal, which is applied to drive the center loudspeaker 28 so as to produce an L+R sound, is delayed a predetermined time with respect to the R signal which is applied to drive the right-hand side loudspeaker 20(R) so as to produce an R sound. Consequently, the passenger M1 will feel the R sound component of the L+R sound produced from the center loudspeaker 28 as an echo produced from the right-hand side loudspeaker 20(R). The L sound component of the L+R sound produced from the center loudspeaker 28 has a channel different from that of the R sound produced from the right-hand side loudspeaker 20(R) and thus it does not cause the passenger M1 to feel the L sound component as an echo sound produced from the right-hand side loudspeaker 20(R). The L sound component produced from the center loudspeaker 28 reaches the left ear of the passenger M1 and causes the passenger M1 to feel a stereophonic sound image along with the R sound produced from the right-hand side loudspeaker 20(R). In other words, the passenger M1 listens the R sound with his right ear and the L sound component with his left ear. Since the volume of the sound produced from the center loudspeaker 28 is greater than the volume of the sound produced from the right-hand side loudspeaker 20(R), as described previously, a good sound balance can be achieved to produce a stereophonic sound image in front of the passenger M1.

With respect to the passenger M2 sitting on the left-hand front seat11, the sound balance is influenced by the sounds produced from the left-hand side loudspeaker 21(L) and the center loudspeaker 28. The L+R signal, which is applied to drive the center loudspeaker 28 so as to produce an L+R sound, is delayed a predetermined time with respect to the L signal which is applied to drive the left-hand side loudspeaker 21(L) so as to produce an L sound. Consequently, the passenger M2 will feel the L sound component of the L+R sound produced from the center loudspeaker 28 as an echo sound produced from the left-hand side loudspeaker 21(L). The R sound component of the L+R sound produced from the center loudspeaker 28 has a channel different from that of the L sound produced from the left-hand side loudspeaker 21(L) and thus it does not cause the passenger M2 to feel the R sound component as an echo sound produced from the left-hand side loudspeaker 21(L). The R sound component produced from the center loudspeaker 28 reaches the right ear of the passenger M2 and causes the passenger M2 to feel a stereophonic sound image along with the L sound produced from the left-hand side loudspeaker 21(L). In other words, the passenger M2 listens the R sound component with his right ear and the L sound with his left ear. Since the volume of the sound produced from the center loudspeaker 28 is greater than the volume of the sound produced from the left-hand side loudspeaker 21(L), as described previously, a good sound balance can be achieved to produce a stereophonic sound image in front of the passenger M2.

The echo sounds produced from the echo sound loudspeakers 30 and 31 placed in front of the respective passengers M1 and M2 have no influence on the produced sound images and are effective to provide deep and spread stereophonic sound images for the passengers. However, the echo sound loudspeakers and the associated circuit are optional and may be removed. In this embodiment, the stereo signal reproducing system employs a single center loudspeaker and represents a smaller cost than that represented by the system in the first embodiment.

There has been provided, in accordance with the present invention, a stereo signal reproducing system which includes a signal generator circuit for generating R and L stereophonic signals. The R signal is applied to drive a right-hand side loudspeaker positioned relative to the right of a listener sitting on the right. The L signal is applied to drive a left-hand side loudspeaker positioned relative to the left of another listener sitting on the left. The R and L signals are applied to drive a center loudspeaker unit positioned between the right- and left-hand side loudspeakers. The R and L signals applied to drive the center loudspeaker unit are delayed a predetermined time with respect to the R and L signals applied respectively to drive the right- and left-hand side loudspeakers. Therefore, either of the listeners can listen an R sound with his right ear and an L sound with his left ear.

Although the present invention has been described in connection with a vehicle compartment, it is to be noted that it is not limited to such an application and is applicable to other compartment such as a listening room having restricted listening position.

While preferred embodiments of the invention has been shown and described, various other embodiments and modifications thereof will be apparent to those skilled in the art, and will fall within the scope of this invention as defined in the following claims.

We claim:

1. A system for reproducing stereophonic signals to create a stereophonic sound image in front of each of first and second side by side listening positions in a compartment, said first listening position being to the right of said second listening position, comprising:

a first side loudspeaker positioned relative to the right of the first listening position;

a second side loudspeaker positioned relative to the left of the second listening position;

a center loudspeaker unit positioned between said first and second loudspeakers; and a signal generator circuit for generating R- and L-channel stereophonic signals, the R-channel signal being applied to drive said first side loudspeaker, the L-channel signal being applied to drive said second side loudspeaker, the R- and L-channel signals being applied to drive said center loudspeaker unit, said signal generator circuit including time delay means for providing a predetermined time delay to the signals applied to drive said center loudspeaker unit with respect to the signals applied to drive said first and second side loudspeakers.

2. The system as claimed in claim 1, wherein said signal generator circuit includes means for controlling the level of the signals applied to drive said center loudspeaker unit to be greater than the level of the signals applied to drive said first and second side loudspeakers.

3. A system for reproducing stereophonic signals to create a stereophonic sound image in front of each of first and second side by side listening positions in a compartment, said first listening position being to the right of said second listening position, comprising:

a first side loudspeaker positioned relative to the right of the first listening position;

a first center loudspeaker positioned relative to the left of the first listening position;

a second side loudspeaker positioned relative to the left of the second listening position;

a second center loudspeaker positioned relative to the right of the second listening position; and a signal generator circuit for generating R- and L-channel stereophonic signals, the R-channel signal being applied to drive said first side loudspeaker, and also to drive said first center loudspeaker, the L-channel signal being applied to drive said second side loudspeaker and also to drive said second center loudspeaker, said signal generator circuit including time delay means for providing a predetermined time delay to the signals applied to drive said first and second center loudspeakers with respect to the signals applied to drive said first and second side loudspeakers.

4. The system as claimed in claim 3, wherein said second center loudspeaker is placed at a smaller distance from said second listening position than said first center loudspeaker.

5. The system as claimed in claim 4, wherein said signal generator circuit includes means for controlling the level of the signals applied to drive said first and second center loudspeakers to be greater than the level of the signals applied to drive said first and second side loudspeakers.

6. A system for reproducing stereophonic signals to create a stereophonic sound image in front of each of first and second side by side listening positions in a compartment, said first listening position being to the right of said second listening position, comprising:

a first side loudspeaker positioned relative to the right of the first listening position;

a second side loudspeaker positioned relative to the left of the second listening position;

a center loudspeaker positioned between said first and second side loudspeakers;

a signal generator circuit for generating R- and L-channel stereophonic signals, said signal generator circuit including means for electrically adding the R- and L-channel signal to provide an L+R signal, the R-channel signal being applied to drive said first side loudspeaker, the L-channel signal being applied to drive said second side loudspeaker, the L+R signal being applied to drive said center loudspeaker, said signal generator circuit including time delay means for providing a predetermined time delay to the L+R signal applied to drive said center loudspeaker with respect to the L and R signals applied to drive said first and second side loudspeakers.

7. The system as claimed in claim 6, wherein said signal generator circuit includes means for controlling the level of the L+R signal applied to drive said center loudspeaker to be greater than the level of the signals applied to drive said first and second side loudspeakers.

8. The system as claimed in claim 6, which includes a first echo sound loudspeaker positioned between said first side loudspeaker and said center loudspeaker, and a second echo sound loudspeaker placed between said second side loudspeaker and said center loudspeaker, and where said signal generator circuit includes means responsive to the L+R signal for generating echo signals for driving said first and second echo sound loudspeakers.

9. A system as recited in claim 3, wherein said signal generator circuit includes means for controlling the level of the signals applied to drive said first and second center loudspeakers to be greater than the level of the signals applied to drive said first and second side loudspeakers.

* * * * *